US005503757A

United States Patent [19]

Ignatow et al.

[11] Patent Number: 5,503,757

[45] Date of Patent: Apr. 2, 1996

[54] REFRIGERANT COMPRESSOR SYSTEM ACID NEUTRALIZER

[75] Inventors: James Ignatow; John L. Kuca, both of Houston, Tex.

[73] Assignee: The Rectorseal Corporation, Houston, Tex.

[21] Appl. No.: 324,765

[22] Filed: Oct. 17, 1994

Related U.S. Application Data

[63] Continuation of Ser. No. 963,911, Oct. 20, 1992, abandoned.

[51] Int. Cl.[6] ..... C10M 125/10; C10M 129/04

[52] U.S. Cl. ..... 252/25; 252/68

[58] Field of Search ..... 252/25, 68, 69, 252/71

[56] References Cited

U.S. PATENT DOCUMENTS

| | | | |
|---|---|---|---|
| 3,119,244 | 1/1964 | Fabian | 62/474 |
| 3,145,161 | 8/1964 | Anderson et al. | 208/275 |
| 3,791,959 | 2/1974 | Mills et al. | 208/19 |

(List continued on next page.)

FOREIGN PATENT DOCUMENTS

| | | |
|---|---|---|
| 0284871A2 | 10/1988 | European Pat. Off. . |
| 1648966 | 7/1971 | Germany . |
| 2246439 | 4/1974 | Germany . |
| 62-254802 | 11/1987 | Japan . |
| 863618 | 9/1981 | U.S.S.R. . |
| 2073769 | 10/1981 | United Kingdom . |

OTHER PUBLICATIONS

Industrial Lubrication and Tribology, vol. 43, No. 6, pp. 10–22 (Nov./Dec. 1991).

Trane, CFC Update, vol. 5 (Dec. 1990).

Sporlan Valve Company, St. Louis, Missouri, Bulletin 240–10–3 (Jun. 1983).

"Standard Test Method for Neutralization Number of Color–Indicator Titration," American National Standard British Standard 2634, pp. 460–466, (1965).

Copeland Corporation brochure (Sidney, Ohio 1970).

ALCO Controls, "Tech Tips from ALCO" (St. Louis, Missouri).

The Refrigerant Management Company, Global Recovery Services brochure, "A New Dimension in Refrigerant Management".

McCain, "Refrigerant Reclamation Protects HVAC Equipment Investment," Ashrae Journal, pp. 32–36 (Apr. 1991).

"A Better Way of System Clean–Up After a Motor Burnout," RCS, pp. 14–22 (Jan. 1991).

"Here's How We'll Handle CFCs," McCarty Bros. article.

"Du Pont Introduces 'Suva' Alternatives; Both 123, 134a Available—at a Price" article (New York).

Tecumseh Manual, "System Cleanup After Burnout," pp. 70–72.

Petty, "Friendswood Inventor Becoming One of Environment's Best Friends," The Houston Post, p. C–15 (Feb. 24, 1992).

"Suction Line Filter–Drier Procedures: A 'How to' Approach," [Anonymous Author].

Sporlan Valve Company Bulletin 40–10, p. 2 (Mar. 1991).

*Primary Examiner*—P. Achutamurthy

*Attorney, Agent, or Firm*—Arnold, White & Durkee

[57] ABSTRACT

An improved composition of matter and method for neutralizing acid in air conditioning or refrigeration systems is disclosed. An acid neutralizing substance (such as an alkali metal hydrate) is supersaturated into an anhydrous alcohol to form an alkaline solution. The solution is then mixed with a lubricating oil, and the resulting mixture introduced into a refrigerant compressor system on the high pressure side of the compressor. The improved composition and method can also be utilized to prevent the formation of acid in a compressor system. The improved composition is also used to neutralize any acid in refrigerants prior to disposal. The improved composition is also used to neutralize any acid in recycled refrigeration oil prior to reuse of the oil.

49 Claims, 2 Drawing Sheets

U.S. PATENT DOCUMENTS

| | | | |
|---|---|---|---|
| 3,912,453 | 10/1975 | Greeley | 436/79 |
| 4,500,557 | 2/1985 | Edging | 426/563 |
| 4,627,928 | 12/1986 | Karn | 252/33 |
| 4,752,381 | 6/1988 | Ferguson et al. | 208/263 |
| 4,818,423 | 4/1989 | Steinbach et al. | 252/49.6 |
| 4,963,282 | 10/1990 | Jolley et al. | 252/67 |
| 5,015,364 | 5/1991 | Harandi | 208/236 |
| 5,015,441 | 5/1991 | Uratani | 422/12 |

REFRIGERANT COMPRESSOR SYSTEM ACID NEUTRALIZER

This application is a continuation of application Ser. No. 07/963,911, filed Oct. 20, 1992, now abandoned.

BACKGROUND OF THE INVENTION

1. Field of the Invention

The present invention relates to an improved process for neutralizing the acid present in an air conditioning or refrigeration (hereinafter, AC or R) system. More particularly, the invention relates to a process for introducing a neutralizing agent into such systems to reduce the presence of acid and thereby reduce the likelihood of compressor burnout.

2. Related Art

Air conditioning and refrigeration (AC or R) systems of all shapes and sizes are in common use throughout industry, commercial establishments, public buildings and residences. Such refrigerant compressor systems can be generally characterized as systems which circulate a compressor fluid comprising a lubricating oil and a refrigerant type of gas that is compressible into a liquid and which is then expanded for absorption of heat. The most common refrigerants used at this time are chlorofluorocarbons (CFCs), more specifically R-11, which is trichlorofluoromethane, R-12 which is dichlorodifluoromethane, and R-22 which is chlorodifluoromethane. The lubricating oil is usually a highly refined naphthenic mineral oil, commonly referred to as refrigeration oil.

A diagrammatic view of a typical AC or R system is shown in FIG. 1. In this typical system, a hermetically or semi-hermetically sealed motor compressor 1 houses an electric motor driven pump that compresses an enclosed suitable refrigerant gas which is liquified and circulated throughout the closed system. The refrigerant passes through a series of devices via a pipe system, typically copper tubing, and carries with it a small portion of the compressor lubricating oil. The refrigerant is first propelled as a compressed, pressurized, hot gas into the high pressure (liquid) side 2 of the system. There, it passes through a muffler 3, a Schrader valve 4, and into a condenser coil unit 5 where it is radiatively cooled in a sufficient amount to condense into a liquid. It then passes through a head pressure control 6 and collects in a liquid refrigerant receiver 7 before moving through a series of devices, including a high pressure side valve 8, a liquid line filter-drier 9, a sight glass 10, a liquid line solenoid valve 11 and a liquid line stabilizer 12. The pressurized liquid refrigerant is then passed through an expansion valve 13 where it is atomized to remove its remaining latent heat and to refrigerate the gas by heat of vaporization. At this point, the cold gas is drawn into the low pressure (suction) side 21 of the system and through an evaporator coil unit 14 where it further expands and radiatively reheats by absorption, cooling the surrounding air being drawn over the coil by heat exchange. Pressure between the high and low pressure sides of the system is controlled by a constant high-low pressure regulator 15. The reheated gas is then discharged through a series of devices, including an evaporator pressure regulator 16, an accumulator 7, a suction line filter-drier 18, a low pressure side control 9 and a low pressure side valve 20 before completing the closed circuit by entering the intake of the motor compressor 1. Depending upon design and sophistication of the AC or R system, other accessory devices may also be found in the system, such as additional pressure regulators and controls, multiple stage cooling coils, manifolds, assorted types of valves and sight glasses, heaters, oil separators, sensors or vibration dampeners.

A major problem with AC or R systems is recurring compressor burnout. The term compressor burnout is used to describe a disabling electrical failure in the compressor's electric motor or related electrical components within the system. Burnout can occur from a variety of causes, including direct damage to the electrical coils of the motor or other electrical system components, or from strain on the motor arising from operating at too high a temperature, at the wrong pressure and/or with an incorrect electrical power supply. While several factors may be the cause of compressor burnout, one of the most common causes is the formation of acid in the compressor fluid.

Acids are generally formed in the compressor fluid by the presence of contaminants and moisture, or the breakdown of refrigerant, refrigeration oil and/or degradation of system parts, neither of which processes can be completely avoided. The contaminants and moisture, along with system operating conditions tend to partially break down the chlorofluorocarbons comprising the compressor fluid, releasing free halogen ions. These ions then combine with moisture to form acids which subsequently attack internal system parts. A major factor in this acid attack is that the internal structure of the AC or R system generally comprises various different materials that are susceptible to acidic attack, including steel, copper and copper alloys, aluminum, various synthetic seals, terminals and insulators. Once acids have formed in the AC or R system, they can cause corrosion and deterioration of various system parts, forcing the compressor motor to work harder, causing direct damage to the compressor motor itself, or causing leaks to form which allow moisture to enter the system promoting further acid formation. Regardless of its source, the presence of acid can eventually result in compressor burnout.

The potentially damaging effects of acid in the AC or R system are well recognized by the industry. Several acid test kits are commercially available which enable one to monitor the acidity of the compressor fluids. The higher the acidity of the fluids, the more likely a compressor burnout will occur.

Once compressor burnout has occurred, the compressor must either be repaired or, more commonly, completely replaced. However, repairing or replacing the compressor does not solve the problem since residual acid contamination is usually still present in other components of the AC or R system, having been circulated and deposited throughout the system by the pumping action of the previous compressor. This residual acid, in conjunction with the system's normal operating conditions, leads to additional acid formation. Therefore, if acid is still present, chemical attack will resume anew and it is simply a matter of time until the new compressor experiences a subsequent burnout. It is not uncommon for this burnout cycle to continue over time, requiring multiple compressor repairs or replacements.

Repairing or replacing compressors has become increasingly more expensive, due in part to recent federal regulations regarding the release of CFC and other halogenated-type refrigerants into the atmosphere. To avoid releasing these refrigerants, various recovery, reclaiming or recycling machines are used which can remove the refrigerant along with entrained refrigeration oil from the system without exposing the fluid or gas to the atmosphere. But, such methods can be extremely expensive. The cost of refrigerants has also increased due to the environmental regulations, and some manufacturers have stopped making certain CFC-type refrigerants altogether. Thus, various methods have been devised to purge the AC or R system of acid whenever the compressor must be repaired or replaced in order to help diminish the likelihood of compressor burnout.

One of the most common methods for purging the system of acid has been to flush the system with some type of refrigerant whenever a compressor must be repaired or replaced. The most common refrigerant used for this purpose has been R-11; however, the same environmental concerns discussed above for using R-11 as a refrigerant apply to the use of R-11 as a flushing agent. R-11 is also becoming extremely expensive and difficult, if not impossible, to obtain in many sections of the nation. Alternative flushing agents include nitrogen, carbon dioxide and pressurized air. However, these gases have little capacity to solubilize the acidized compressor fluids and are, therefore, relatively ineffective at acid removal. Further, unless used in an absolutely dry state, these compressed gases will introduce moisture into the system which will help promote acid formation.

Another problem associated with trying to flush an air conditioning or refrigeration system is that some acid may remain in the system despite the flushing efforts. Once acid has begun to form, it can spread throughout the compressor fluid and into any of the system's internal components. When the fluid is flushed, some acid is likely to remain in the system, either in the reservoirs of lubricating oil, as surface deposits, or attached as corrosion to the seals or other internal parts, or simply in some small pocket of compressor fluid which did not flush. Any acid which remains in the system will likely resume chemical attack of system parts and precipitate the formation of more acid once new compressor fluid is added and the system is running again.

Since flushing the system is recognized in the industry as inadequate to solve the acidity problem, other methods have been devised to combat the problem of acid formation. Many repairmen attempt to "triple-flush" a system, which may be more effective than a single flush, but has the same inherent deficiencies stated above. Another common method for purging acid is to replace the refrigeration oil either once or repeatedly in order to dilute the residual acid in the system. Some times this method is combined with the R-11 refrigerant flushing method. In addition to the inherent deficiencies noted for the R-11 method, replacement of refrigeration oil is similarly ineffective at completely removing acids. Additionally, such procedures are expensive and produce waste oil which must be disposed of as regulated hazardous waste.

Yet another common method of reducing the deleterious effects of acid is the use of filter-driers (See, e.g. in FIG. 1 9, 18) in an AC or R system. Installation of common filter-driers is a widely recognized standard practice when repairing AC or R systems, regardless of the mode of failure. Common filter-driers driers are designed to remove contaminants and water from the compressor fluid as it circulates through the system. However, these devices are not effective at removing acid unless special composition filter-drier elements are used. Even then, the acids are merely absorbed into, or adsorbed onto, the filter element and are not entirely removed from the system. If the acids are dislodged from or manage to bleed through the filter element, or if the element becomes saturated, then the problem still remains. Additionally, the filter-drier must be checked and maintained with periodic filter element replacement to remain effective, as a partially blocked filter will add additional strain to the system causing the compressor motor to work harder and likely create more acid.

Since the presence of acid in the compressor fluid is a major cause of compressor burnout, effective neutralization of the acid in the system would be expected to contribute to a reduction of burnout problems. One such method is disclosed by Fabian in U.S. Pat. No. 3,119,244. Fabian discloses a refrigerant treatment element which is a cylinder containing an amount of soda, namely sodium bicarbonate. The treatment element is designed so that the compressor fluid comes into contact with the soda and any acid is thus neutralized. A non-solution form of a buffered acid salt is used as a weak neutralizing agent. The agent is restricted to a predetermined quantity in a fixed location on the compressor high pressure side of a refrigeration system. Acid contamination within the system is then required to migrate as part of the compressor fluid completely around the system in order to be neutralized at that fixed location. In order to undergo neutralization, the acid must then intimately contact previously unreacted sodium bicarbonate within the constraints of the dead-end lower chamber of a refrigerant treating element and remain there, coincident with moisture, for sufficient time for the neutralization reaction to occur.

Additionally, predetermined quantities of sodium bicarbonate may be stoichiometrically insufficient to neutralize the amount of acid formed in any given compressor. Because the neutralization agent is only at one very restricted access location, and because the neutralizing compound is not in solution and is not inherently a strong reactant, all acid within a system may not come in contact with the fixed neutralizer in order to undergo reaction. In fact, some acid species may not react with the soda at all regardless of contact. Furthermore, even where that acid which is capable of reacting with the soda neutralizer does actually contact the neutralization agent it may not do so for a sufficient period of time to be effectively neutralized. Further, any neutralization reactions that do occur with the soda can produce insoluble salts which could shield remaining unreacted sodium bicarbonate from contact and further reaction with any remaining acids. Lastly, acid reactions with sodium bicarbonate often produce carbon dioxide. The presence of this gas in an air conditioning or refrigeration system is detrimental in that it can result in system over-pressurization, heat transfer efficiency losses and/or recombination with any moisture present which can re-introduce a mild acid into the system.

U. S. Pat. No. 5,015,441, issued to Uratani on May 14, 1991, discloses a method for preventing corrosion of internal metal surfaces of air compression devices comprised of electrolytically generating a basic aqueous solution, then injecting that solution under pressure into the operating air compressor system to neutralize acidic water condensate which may be formed within the system. This method, however, would not work well with air conditioning or refrigeration systems because any introduction of water, however slight, into such a system can cause the CFCs to partially breakdown releasing halogen ions and leading to the production of more acid. AC or R systems are not designed to compress externally drawn air for subsequent discharge. Rather, they are designed to operate as closed loop, sealed fixed volume liquid/vapor heat transfer devices. Their internal operating environment is entirely different and the injection of large quantities of water (as for air compressors) would be catastrophic for AC or R systems. Not only would acid content generation and refrigerant degradation be grossly affected, but the system's fixed liquid volume capacity would be exceeded causing heat transfer efficiency problems. Additionally, water would interfere with the function of exposed internal electrical components leading to rapid electrical system failure, and reduction in refrigeration oil lubricity which could lead to early mechanical failure.

Thus, there is a need for a method for neutralizing the acid in an air conditioning or refrigeration system which more effectively eliminates the acid and does not introduce water or other contaminants into the system. In particular, compositions and methods are needed which circulate agents capable of neutralizing the types of acids responsible for compressor burnout to all affected internal surfaces of AC or R systems.

SUMMARY OF THE INVENTION

The present invention is directed toward an improved composition and method for neutralizing the acid in an air conditioning or refrigeration system which addresses the disadvantages inherent in prior compositions and methods. The method is designed to quickly neutralize all of the acid present in an AC or R system, rather than merely filtering the acid leaving it vulnerable to escaping and re-entering the system. The composition and method are designed so that no constituents (such as water) are added to the compressor fluids which may create other problems and contribute to compressor burnout.

The present invention in one general aspect comprises a composition for neutralizing acid in an AC or R system, comprising an alcohol soluble neutralizing compound, an anhydrous alcohol, and a lubricating oil suitable for the system. An AC or R system means any type of refrigerant compressor system which circulates a refrigerant gas that is compressible into a liquid and then expands for the absorption of heat. The present invention in another aspect comprises a method for introducing the composition into an AC or R system so as to neutralize the acid.

According to one embodiment of the composition, alcohol soluble neutralizing compound consists of an alkali metal hydrate, an amine or an alkaline salt. In another embodiment the composition comprises anhydrous isopropyl alcohol. According to a preferred embodiment, the composition comprises potassium hydroxide supersaturated into anhydrous isopropyl alcohol, and mixed with a refined naphthenic mineral oil suitable for use as a lubricant in any particular system.

According to one embodiment of the method of this invention, an alkaline solution suitable for neutralizing the acid in an AC or R system is mixed with a lubricating oil and introduced into the system. In another embodiment, the alkaline solution is dehydrated before being mixed with the lubricating oil, and is then introduced into the AC or R system.

In a preferred embodiment of the method of this invention, potassium hydroxide is supersaturated into a solvent of anhydrous isopropyl alcohol, and the resulting mixture is dehydrated following supersaturation. The alkaline solution is then mixed with a suitable lubricating oil, and the mixture is introduced into the AC or R system at a point on the high pressure side of the compressor.

In another embodiment, the compositions and methods of the present invention find utility as means of preventative maintenance. Preventative maintenance of AC or R systems becomes an increasingly valuable approach to reducing frequency of compressor burnout, as the size and cost of the unit increases and as the accessibility of the unit for maintenance decreases. Since overtreatment, while not typically a problem with infrequent use, may have certain deleterious effects, the method disclosed herein for preventative maintenance provides steps for determining the preferred treatment level and treatment frequency.

In yet another embodiment, the compositions and methods of this invention are employed to neutralize acid in spent halocarbon refrigerants. Spent halocarbon refrigerant is removed from an AC or R system for maintenance or repair. The compositions of this invention are mixed with spent halocarbon refrigerants in stoichiometrically sufficient amounts to neutralize the acids in the refrigerant. The spent halocarbon refrigerant can then be reused.

In yet another embodiment, the compositions and methods of this invention are employed to neutralize acid in spent refrigerant oil. Spent refrigerant oil is oil removed from an AC or R system for maintenance or repair. The compositions of this invention are mixed with spent refrigerant oils in stoichiometrically sufficient amounts to neutralize the acids in the oils. The spent oil can then be further treated for reuse or disposal.

DETAILED DESCRIPTION OF THE PREFERRED EMBODIMENT

Figure 1:
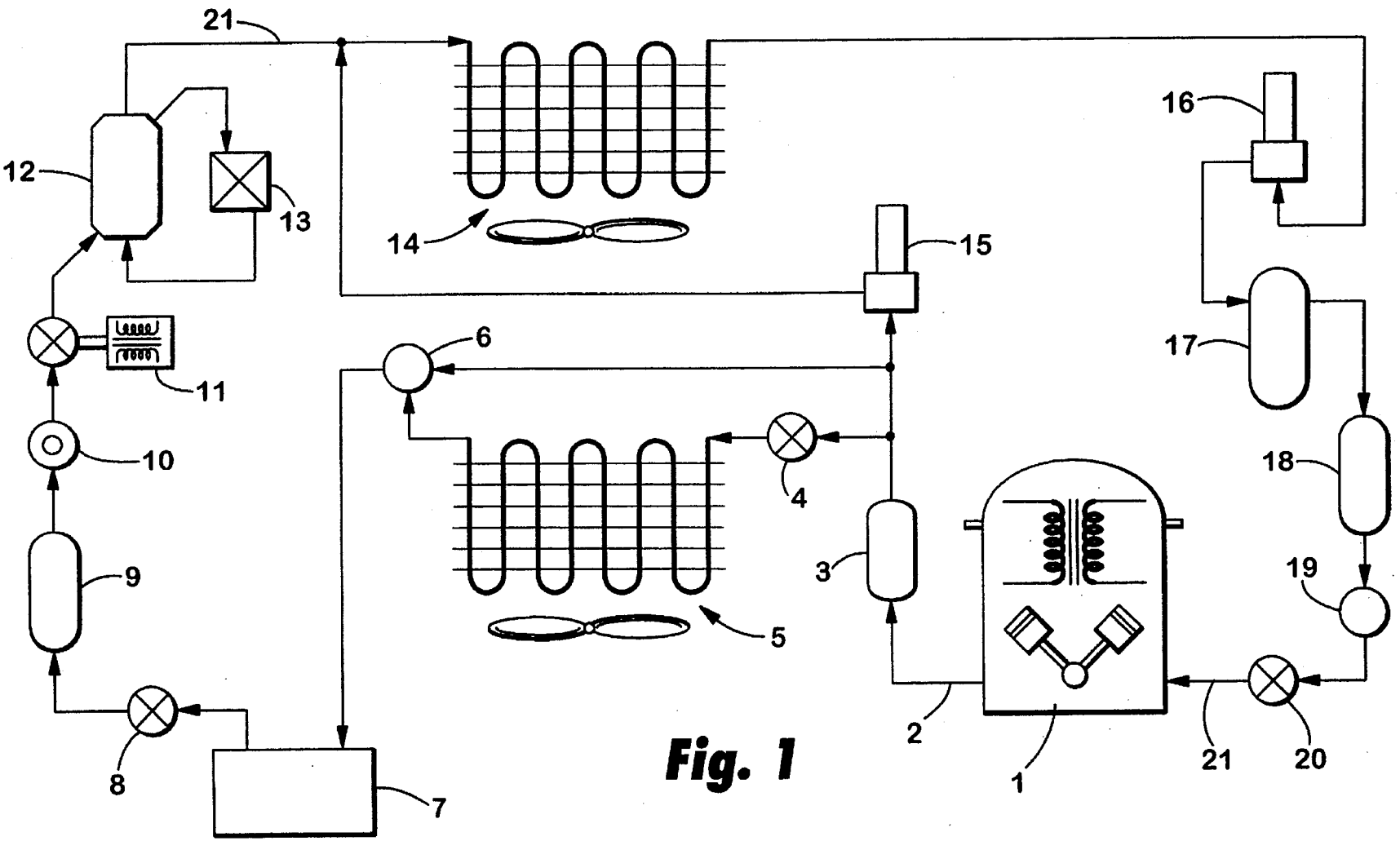
FIG. 1 shows a diagrammatic view of a typical AC or R system

This invention provides a method for mixing an alkaline solution with lubricating oil, and injecting that mixture into an AC or R system so as to reduce acidity within the system. An AC or R system is any refrigerant compressor system which circulates a refrigerant gas that is compressible into a liquid and which is then expanded for absorption of heat.

One important aspect of this invention lies in creating an alkaline solution which may be added to the compressor fluids as a neutralizer without disrupting the operation of the AC or R system. As stated above, any aqueous solution tends to create problems by promoting the formation of acid and by interfering with heat transfer efficiency, internal electrical functions and refrigeration oil lubricity. Therefore, the neutralizer should be one comprising an anhydrous solvent such as alcohol. Anhydrous alcohol of about $C_{1-12}$, has been found to be an effective solvent, and anhydrous isopropyl alcohol is a preferred solvent.

The solute preferably comprises a strongly alkaline material such as an alkali metal hydrate or other type of alkaline compound. While amines may be used, certain amines affect compressor fluids by creating cloudiness, separation, and an unpleasant odor. Additionally, while certain amines may find utility in the compositions of the invention, many amines are not reactive enough with acids typically encountered in AC or R systems, so that relatively large quantities must be added to the compressor fluid to effectively neutralize the acid. If an amine is to be used as the alkaline material, the amine may be any primary, secondary, tertiary, or quaternary amine, with normal propyl amine being preferred from that group. Similarly, various other alkaline salts soluble in anhydrous alcohol may be used, but care should be taken if utilizing alkaline salts as they too many tend to be sufficiently reactive. Some suitable alkaline salts include inorganic alkaline salts such as lithium metaphosphate and organic alkaline salts such as potassium salicylate. However many alkaline salts can produce reaction products which are less than desirable in AC or R systems (e.g., insoluble or waxy solids, gases or free water).

Thus, pursuant to the present invention, it has been found that alkaline metal hydrates are the most effective solutes for the alkaline solutions referred to above. Some alkaline metal hydrates, most notably sodium hydroxide, are less preferred than others for the compositions of the invention because of their lower solubility in anhydrous alcohols. A preferred solute is potassium hydroxide, most preferably having a purity of at least about 90%.

The alcohol/alkaline solution should be supersaturated so as to increase or maximize the amount of neutralizing agent in solution. The alcohol should be heated, and then the potassium hydroxide added. Since potassium hydroxide is extremely hygroscopic, any water which may be present in solution should preferably be removed by a suitable drying method such as centrifuging, distillation, decanting, microfiltration, molecular sieving, absorption or adsorption.

A preferred method for preparing the alcohol/alkaline solution is to heat anhydrous isopropyl alcohol to a sufficiently high temperature to readily dissolve solid potassium hydroxide to a point of supersaturation, but low enough so as to reduce or minimize high evaporative effects from the alcohol. Suitable temperature ranges for heating have been found to be 120° F. to 150° F.

The solution should be prepared in a closed vessel made inert with a blanket of dry nitrogen or other suitable anhydrous gas to preclude moisture. After cooling, the solution should be dried to a moisture content of not greater than about thirty parts per million and maintained in that dry state until use.

The resulting concentrated solution may be introduced as a neutralizing agent. However, because of its hygroscopic nature, its volatility, and its neutralization potency in very small volumetric quantities, the alcohol/alkaline solution as such is difficult to use effectively as an AC or R system neutralizing agent. The preferred finished composition is achieved by mixing the solution with a suitable refrigerant lubricating oil, most preferably refined naphthenic mineral oil. The most preferred lubricating oil has the following characteristics:

ASTM D445 viscosity of 30.0 centistokes at 100° F.
ASTM D1250 specific gravity of 0.900 at 77° F.
ASTM D97 pour point of −50° F.
ASTM D92 flashpoint of 345° F.
ASTM D1500 color of L0.5.
ASTM D611 aniline point of 177° F.
ASHRAE 86-83 floc point of −65° F.
ASHRAE 97-89 sealed tube stability of passing The mixing of the alcohol/alkaline solution with the lubricating oil is preferably carried out under dry conditions and the resulting composition should be maintained in that dry state until use.

Preferred compositions for the finished AC or R system neutralization agent is set out in Table I. The table shows the individual constituents of the composition and the percent by weight range of those constituents in the composition. Persons skilled in the art will, of course, be able to determine other similar constituents and other suitable percents by weight of those constituents for a different neutralizer composition. Any such variation is anticipated in these ranges.

TABLE I

| | PERCENT BY WEIGHT | | |
|---|---|---|---|
| CONSTITUENT | ACCEPT-ABLE | PREFERRED | MOST PREFERRED |
| potassium hydroxide, 90% assay | 0.1 to 3.3 | 0.2 to 0.4 | 0.3 |
| anhydrous isopropyl alcohol | 0.7 to 20.3 | 1.3 to 2.5 | 1.9 |
| highly refined naphthenic mineral oil | 76.4 to 99.2 | 97.1 to 98.5 | 97.8 |

Since acids formed in AC or R systems may vary unpredictably in composition, some neutralization reactions may occur which could produce trace amounts of insoluble precipitates or other undesirable reaction products within the system. In keeping with common repair practices, usage of ordinarily installed filter-driers driers may be expected to remove any such reaction products should they form.

Care should be taken that at least the stoichiometric amounts of neutralizer are added to an AC or R system to help ensure that all acid within the system is neutralized. Any excess neutralizer added will beneficially serve the system by being available to react with acid that is formed in the future as the system operates. Neutralizer amounts up to forty times greater than that which is stoichiometrically required have been shown to be not detrimental to AC or R systems, provided the addition of excess neutralizer does not cause system liquid volume capacities to exceed greater than ten percent of maximum recommended capacity.

First, the acid number of the compressor fluids should be determined. This can be calculated by use of ASTM test no. D974 or D664, incorporated specifically herein by reference. These tests are designed for the determination of acidic or basic constituents in petroleum products. The acid number is typically somewhere between 0 and 0.40, but may be substantially higher depending upon the conditions and circumstances to which the compressor fluids have been subjected.

Figure 2:
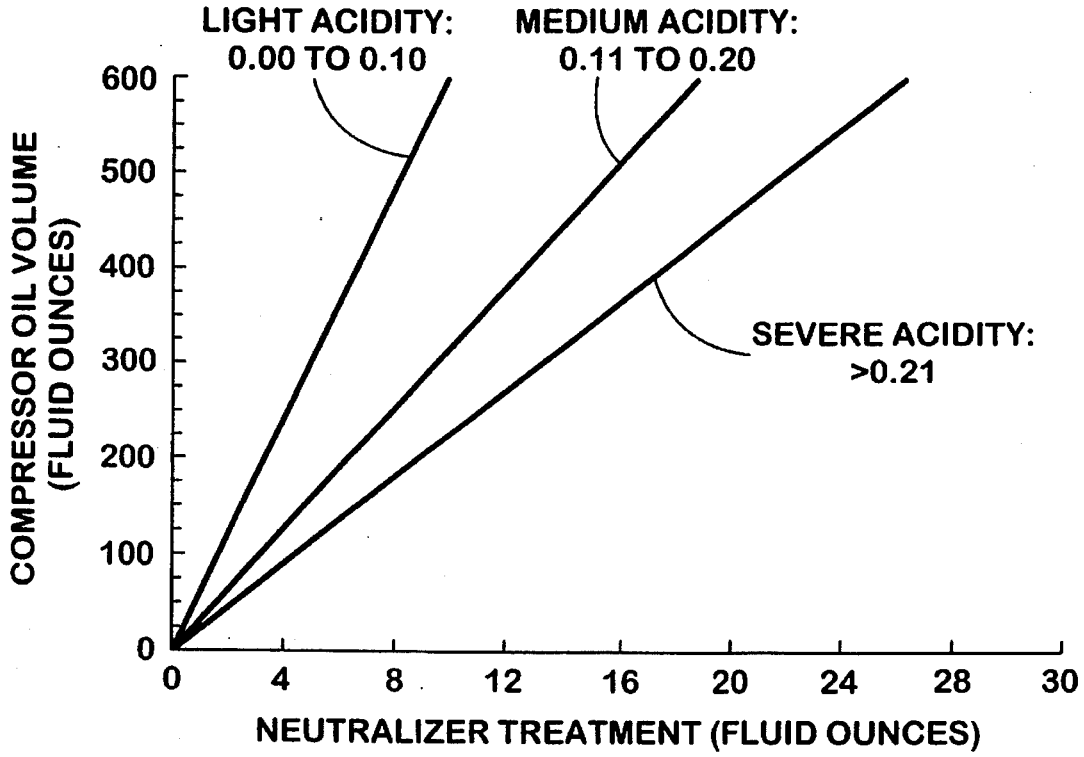
FIG. 2 shows three curves which may be utilized to determine the proper amount of neutralizer to add to an AC or R system.

Next, a volume of neutralizer is chosen which will stoichiometrically neutralize the acid in the system. FIG. 2 provides a chart for determining a range of adequate volumes for a neutralizer prepared from potassium hydroxide, anhydrous isopropyl alcohol, and compressor oil as described herein. One skilled in the art will be able to determine the proper volumes for a different neutralizer composition. An acid number of 0 to 0.10 is considered light acidity, 0.11 to 0.20 is medium acidity, and anything above 0.21 is severe acidity. If the neutralizer is being added to the system as a preventive measure before any acid has developed, the light acidity curve should be utilized.

The neutralizer is then added to the AC or R system. Although the neutralizer may be added almost anywhere in the system, the preferred method is to add the neutralizer immediately downstream from the compressor, which is referred to as the liquid or high pressure side 2. To accomplish this, the neutralizer is injected through a Schrader valve 4, while the system is in operation, using a refrigeration oil pump of the type ordinarily used by repairmen to charge refrigeration oil to the system. Adding the neutralizer to the high pressure side of the AC or R system helps ensure that the neutralizer contacts and reacts with the residual acid in the system in the shortest time possible. Once the neutralizer enters the compressor 1 it may remain there for some time, because the refrigeration oil tends to circulate quite slowly throughout the system, and often collects in the compressor. If the neutralizer is added directly to the compressor, or at point on the low pressure side of the compressor 21, the neutralizer may remain in the compressor and take weeks to circulate throughout the system.

The effectiveness of this method for neutralizing the acid of an AC or R system is demonstrated by the following example.

EXAMPLE I

An old out of service air conditioning unit containing a 2¼ ton Copeland compressor was reactivated and treated with the acid neutralizer. The unit was run continuously for approximately 180 hours and monitored during that run for acid content by ASTM D974 titrimetric determination of acid number. The compressor specifications indicated an original refrigeration oil volume of 56 fluid ounces with a recommended recharge volume of 51 fluid ounces. The 5 fluid ounce differential was assumed to be residual oil retained in the non-compressor parts of the air conditioning system. The initial acid number of the old refrigeration oil was determined to be 2.90 milligrams potassium hydroxide per gram of oil. By calculation, it was determined that 3.92 grams of a 12.5 weight percent solution of potassium hydroxide in anhydrous isopropyl alcohol would be required to stoichiometrically neutralize the 5 fluid ounces (assumed) of retained acidified refrigeration oil.

Procedurally, the old refrigeration oil was drained from the compressor crankcase and replaced with 51 fluid ounces of new Sunisco 3GS refrigeration oil. The calculated amount of neutralizer treatment was then added directly into the compressor and the system was immediately sealed, evacuated and charged with the recommended amount of R-22 refrigerant.

The air conditioning unit was then energized, started and run continuously to circulate the compressor fluid and treatment within the system. After approximately 2 hours, the refrigeration oil was sampled and its acid number was determined to have dropped to 0.39. After 5 hours, the acid number was essentially unchanged.

Thereafter, a second treatment of 0.6 gram of neutralizer was injected into the low pressure side of the system just before the compressor intake. After 12 additional hours of run time, the acid number had dropped further to 0.13.

A similar third treatment was administered and the unit was continuously run for another 165 hours, whereupon the acid number had dropped to essentially zero.

Figure 3:
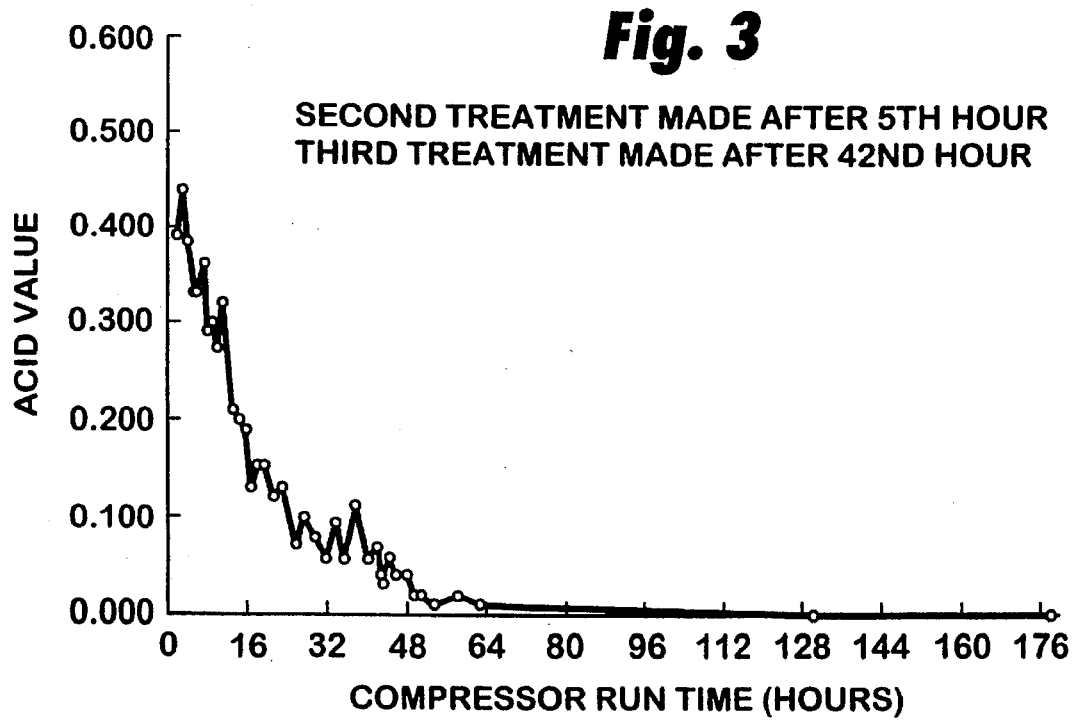
FIG. 3 shows the acid number reduction of an actual air conditioning system utilizing the present invention.

As illustrated in FIG. 3, acid numbers determined periodically across the entire 180 hour run time showed an early sharp decline followed by a lessening rate of decline with time until the acid was essentially neutralized at about the 7 day point.

This experiment demonstrated the efficacy of the neutralization treatment method in an actual operating refrigerant compressor system.

EXAMPLE II

Later experiments allowed more precise predetermination of dosages required, permitting single treatments to be used to effect complete neutralization. These experiments also demonstrated that administration of the treatment to the high pressure side of air conditioning and refrigeration systems drastically reduced neutralization times from weeks or days down to a matter of hours.

TABLE II

| Compressor and Size | Initial Acid No. | Neutralizer Dosage | Final Acid No. |
|---|---|---|---|
| Tecumseh 7.5 ton | 0.13 | 4 fl. oz. | 0.01 |
| Trane 45 ton | 0.04 | 8 fl. oz. | 0.02 |
| Unknown 0.5 ton | 0.09 | 1 fl. oz. | 0.00 |
| Copeland 25 ton | 0.23 | 8 fl. oz. | 0.01 |
| Copelametic 25 ton | 0.42 | 12 fl. oz. | 0.02 |
| Copelametic 10 ton | 0.90 | 32 fl. oz. | 0.00 |

Table II shows the data from some of these experiments. The table shows the size and type of the compressor, the initial acid number of the compressor fluid, the dosage of neutralizer added, and the final acid number resulting from the treatment.

The composition of this invention can be alternatively utilized as preventative maintenance treatment agents or as neutralizing agents for used refrigerant fluids.

Almost all AC or R systems will eventually develop acid in the refrigerant fluids. The treatment methods and compositions of this invention described above address the problem of neutralizing acid once it has developed, but the methods and compositions provided herein can also be used to help prevent the formation of acid. Thus, a small dosage of 1 to 10 fluid ounces should be sufficient to neutralize acid as it begins to form in a system, based upon the previously noted light acidity dosage level and dependent upon the compressor oil volume to be treated as shown in FIG. 1. Additional dosages can be added with routine maintenance checks, and periodic tests for the acid number will help ensure that proper amounts of the neutralizing agent are added. As stated above, the introduction of excess neutralizer into a system has no known detrimental effects, although system liquid volume capacities should not exceed ten percent over the recommended maximum.

The neutralizing agent is also useful for neutralizing acidic refrigerants as they are collected from AC or R systems by recovery, reclaiming, and/or recycling machines. Refrigerants collected under this method are generally intended for reuse, although they may be collected for disposal. The neutralizing agent can be added to such refrigerants as or after they are removed from the AC or R system in an amount at least stoichiometrically sufficient to neutralize the acid present in the refrigerant.

Similarly, the compositions of this invention may be employed as neutralizing treatments for waste refrigeration oils prior to reclamation for reuse or prior to disposal to render the waste oil less acidic and therefore less hazardous. Again, the neutralizing agent should be added in a stoichiometrically sufficient amount based upon the acidity of the oil, and anyone skilled in the art will be able to determine the appropriate amount to add.

While various modifications and changes of the methods and compositions described above will be apparent to one having ordinary skill in the art, such changes are included in the spirit and scope of this invention as defined by the appended claims.

What is claimed is:

1. A substantially anhydrous composition for neutralizing acid in a refrigerant compressor system consisting essentially of a mixture of:

an alkaline solution consisting essentially of an alcohol soluble neutralizing agent dissolved in an anhydrous $C_1$ to $C_{12}$ alcohol; and a refrigerant compressor system lubricating oil.

2. The composition of claim 1 wherein the compressor system is an air conditioning compressor system.

3. The composition of claim 1 wherein the compressor system is a refrigeration compressor system.

4. The composition of claim 1 wherein the neutralizing agent is an alkali metal hydroxide or amine.

5. The composition of claim 1 wherein the neutralizing agent is an alkali metal hydroxide.

6. The composition of claim 5 wherein the alkali metal hydroxide is an alkali metal hydroxide formed from metals in Group IA of the periodic table.

7. The composition of claim 4 wherein the neutralizing agent is a primary amine.

8. The composition of claim 1 wherein said anhydrous alcohol is anhydrous isopropyl alcohol.

9. The composition of claim 1 wherein the lubricating oil is a refined naphthenic mineral oil.

10. The composition of claim 1 wherein the neutralizing agent is potassium hydroxide.

11. The composition of claim 1 wherein the neutralizing agent is sodium hydroxide.

12. A substantially anhydrous composition for neutralizing the acid in an air conditioning or refrigeration compressor system consisting essentially of:

potassium hydroxide;

anhydrous isopropyl alcohol; and a refined naphthenic refrigeration lubricating oil.

13. The composition of claim 1 consisting essentially of:

about 0.1 to 3.3 percent by weight of potassium hydroxide;

about 0.7 to 20.3 percent by weight of anhydrous isopropyl alcohol; and about 76.4 to 99.2 percent by weight of refined naphthenic refrigeration lubricating oil.

14. The composition of claim 12 consisting essentially of:

about 0.2 to 0.4 percent by weight of potassium hydroxide;

about 1.3 to 2.5 percent by weight of anhydrous isopropyl alcohol; and about 97.1 to 98.5 percent by weight of refined naphthenic refrigeration lubricating oil.

15. The composition of claim 12 consisting essentially of:

about 0.3 percent by weight of potassium hydroxide;

about 1.9 percent by weight of anhydrous isopropyl alcohol; and about 97.8 percent by weight of refined naphthenic refrigeration lubricating oil.

16. A method for reducing acidity in a refrigerant compressor system comprising:

mixing an anhydrous alkaline solution consisting essentially of an alcohol soluble neutralizing agent dissolved in an anhydrous $C_1$ to $C_{12}$ alcohol, said solution being suitable for neutralizing acid within the system, with a refrigerant compressor system lubricating oil; and introducing the resulting mixture into said compressor system.

17. The method in claim 16 wherein the compressor system is an air conditioning compressor system.

18. The method in claim 16 wherein the compressor system is a refrigeration compressor system.

19. The method in claim 15 wherein said neutralizing agent is an alkali metal hydroxide.

20. The method in claim 16 wherein said alkaline solution comprises potassium hydroxide and anhydrous isopropyl alcohol.

21. The method in claim 16 wherein said alkaline solution is a supersaturated solution of an alkali metal hydroxide in said anhydrous alcohol.

22. The method in claim 16 wherein said alkaline solution is a supersaturated solution of potassium hydroxide in anhydrous isopropyl alcohol.

23. The method in claim 16 wherein said lubricating oil is a refined naphthenic mineral oil.

24. The method in claim 16 wherein said alkaline solution is further dehydrated prior to said mixing with said lubricating oil.

25. The method in claim 16 wherein said mixture is introduced into said refrigerant compressor system on the high pressure side of the compressor.

26. The method of claim 16 wherein said neutralizing agent is sodium hydroxide.

27. A method for reducing the acidity in an air conditioning or refrigeration compressor system comprising the steps of:

supersaturating potassium hydroxide into a solvent of anhydrous isopropyl alcohol;

dehydrating the supersaturated solution of potassium hydroxide and anhydrous isopropyl alcohol;

mixing said solution with a refined naphthenic mineral oil;

determining the acidity of the fluid in the system; and introducing an amount of the mixture stoichiometrically sufficient to neutralize the acidity of the fluid into the system at a point on the high pressure side of the compressor.

28. A method for inhibiting the production of acid in a refrigerant compressor system comprising:

mixing an anhydrous alkaline solution consisting essentially of an alcohol soluble neutralizing agent dissolved in an anhydrous $C_1$ to $C_{12}$ alcohol, said solution being suitable for neutralizing said acid, with a refrigerant compressor system lubricating oil; and introducing the resulting mixture into said compressor system.

29. The method in claim 28 wherein the compressor system is an air conditioning compressor system.

30. The method in claim 28 wherein the compressor system is a refrigeration compressor system.

31. The method in claim 18 wherein said neutralizing agent is an alkali metal hydroxide.

32. The method in claim 28 wherein said alkaline solution comprises potassium hydroxide and anhydrous isopropyl alcohol.

33. The method in claim 28 wherein said alkaline solution is a supersaturated solution of an alkali metal hydroxide in said anhydrous alcohol.

34. The method in claim 28 wherein said alkaline solution is a supersaturated solution of potassium hydroxide in anhydrous isopropyl alcohol.

35. The method in claim 28 wherein said lubricating oil is a refined naphthenic mineral oil.

36. The method in claim 28 wherein said alkaline solution is further dehydrated prior to said mixing with said lubricating oil.

37. The method in claim 28 wherein said mixture is introduced into said refrigerant compressor system on the high pressure side of the compressor.

38. The method of claim 28 wherein said neutralizing agent is sodium hydroxide.

39. A method for neutralizing the acid in spent refrigeration oil that has been removed from a refrigerant compressor system comprising:

mixing an anhydrous alkaline solution consisting essentially of an alcohol soluble neutralizing agent dissolved in an anhydrous $C_1$ to $C_{12}$ alcohol, said solution being suitable for neutralizing said acid, with a refrigerant compressor system lubricating oil; and introducing an amount of the resulting mixture stoichiometrically sufficient to neutralize said acid into said spent oil.

40. The method in claim 39 wherein said alkaline solution comprises an alkali metal hydroxide and said anhydrous alcohol.

41. The method in claim 39 wherein said neutralizing agent is an alkali metal hydroxide.

42. The method in claim 39 wherein said alkaline solution is a supersaturated solution of an alkali metal hydroxide in said anhydrous alcohol.

43. The method in claim 39 wherein said alkaline solution is a supersaturated solution of potassium hydroxide in anhydrous isopropyl alcohol.

44. The method in claim 39 wherein said lubricating oil is a refined naphthenic mineral oil.

45. The method in claim 39 wherein said alkaline solution is further dehydrated prior to said mixing with said lubricating oil.

46. The method of claim 39 wherein said neutralizing agent is sodium hydroxide.

47. A substantially anhydrous composition for neutralizing the acid in an air conditioning or refrigeration compressor system consisting essentially of:

an alcohol soluble neutralizing agent;

$C_1$ to $C_{12}$ anhydrous alcohol; and a refined naphthenic lubricating oil.

48. The composition of claim 47 wherein the neutralizing agent is an alkali metal hydroxide.

49. The composition of claim 47 wherein the neutralizing agent is an amine.

* * * * *